US008479430B1

(12) United States Patent
Masten

(10) Patent No.: US 8,479,430 B1
(45) Date of Patent: Jul. 9, 2013

(54) SHELL STORAGE SYSTEM FOR GUNSTOCKS

(76) Inventor: Joe Masten, Anchorage, AK (US)

( * ) Notice: Subject to any disclaimer, the term of this patent is extended or adjusted under 35 U.S.C. 154(b) by 117 days.

(21) Appl. No.: 12/807,391

(22) Filed: Sep. 3, 2010

(51) Int. Cl.
*F41C 27/00* (2006.01)

(52) U.S. Cl.
USPC ..... 42/85; 42/72

(58) Field of Classification Search
USPC ..... 42/85, 72, 87, 106
See application file for complete search history.

(56) References Cited

U.S. PATENT DOCUMENTS

| | | | | | |
|---|---|---|---|---|---|
| 1,110,209 | A | * | 9/1914 | Kirchner | 42/71.01 |
| 1,526,847 | A | * | 2/1925 | Fritz | 42/71.01 |
| 2,476,355 | A | * | 7/1949 | Brown | 42/71.01 |
| 2,495,977 | A | * | 1/1950 | Madsen | 42/71.01 |
| 2,587,921 | A | * | 3/1952 | Suite | 42/71.01 |
| 2,605,033 | A | * | 7/1952 | Terry | 224/5 |
| 2,931,120 | A | * | 4/1960 | Kolin | 42/18 |
| 3,623,256 | A | * | 11/1971 | Shiplee, III | 42/50 |
| 3,638,344 | A | * | 2/1972 | Wagner et al. | 42/71.01 |
| 3,798,819 | A | * | 3/1974 | Hillberg | 42/72 |
| 4,100,694 | A | * | 7/1978 | Musgrave | 42/90 |
| 4,115,943 | A | * | 9/1978 | Musgrave | 42/90 |
| 4,484,404 | A | * | 11/1984 | Johnson | 42/90 |
| 4,628,627 | A | * | 12/1986 | Johnson | 42/90 |
| 4,697,367 | A | * | 10/1987 | Brophy | 42/71.01 |
| 4,850,127 | A | * | 7/1989 | Davis et al. | 42/71.01 |
| 4,882,973 | A | * | 11/1989 | Piscetta | 89/1.41 |
| 4,944,109 | A | * | 7/1990 | Zedrosser | 42/71.01 |
| 4,982,520 | A | * | 1/1991 | Lee | 42/49.01 |
| 5,121,564 | A | * | 6/1992 | Story | 42/90 |
| 5,159,136 | A | * | 10/1992 | Marsh | 42/71.01 |
| 5,225,613 | A | * | 7/1993 | Claridge | 42/74 |
| 5,253,442 | A | * | 10/1993 | Kim | 42/50 |
| 5,265,365 | A | * | 11/1993 | Finn | 42/74 |
| 5,615,506 | A | * | 4/1997 | Jackson et al. | 42/50 |
| 5,636,465 | A | * | 6/1997 | Johnson | 42/90 |
| D382,037 | S | * | 8/1997 | Scott et al. | D22/108 |
| 5,813,157 | A | * | 9/1998 | Scott et al. | 42/71.01 |
| 6,250,194 | B1 | * | 6/2001 | Brandl et al. | 89/1.41 |
| 6,253,481 | B1 | * | 7/2001 | Melby | 42/90 |
| 6,374,719 | B1 | * | 4/2002 | Phillips | 89/34 |
| 6,536,152 | B1 | * | 3/2003 | Wisz | 42/71.01 |
| 6,640,480 | B2 | * | 11/2003 | Williams et al. | 42/95 |
| 6,698,129 | B1 | * | 3/2004 | Hanks | 42/90 |
| 6,763,755 | B2 | * | 7/2004 | Johnson | 89/1.42 |
| 6,829,855 | B2 | * | 12/2004 | Seifert | 42/90 |
| 6,854,205 | B2 | * | 2/2005 | Wikle et al. | 42/71.02 |
| 6,874,618 | B1 | * | 4/2005 | Cragg | 206/3 |
| 6,901,837 | B2 | * | 6/2005 | Johnson | 89/1.4 |
| 6,952,896 | B2 | * | 10/2005 | Davis | 42/71.01 |
| 6,981,344 | B2 | * | 1/2006 | Cahill et al. | 42/71.01 |

(Continued)

*Primary Examiner* — Benjamin P Lee
(74) *Attorney, Agent, or Firm* — Michael J. Tavella

(57) ABSTRACT

An ammunition carrier that is attached to a gun in apposition that does not interfere with the operation of the gun. The carrier is attached to the gun using a locking slider system. Once in place, it allows a shooter to carry up to 24 shells simply and easily. The carrier can be made in a straight-line design or a pistol grip type design. The carrier has Velcro patches that allow the shell holders to be attached. The shell holders have elastic bands that hold the shells. One or two shell holders can be attached to the carrier as desired. A user can keep several carriers available, each with a different type of shot or load so that the user simply has to select the desired ammunition for a particular purpose and attach it to the gun. It can also be used to carry ammo clips for rifles.

10 Claims, 11 Drawing Sheets

U.S. PATENT DOCUMENTS

| | | | | |
|---|---|---|---|---|
| 7,493,718 | B2 * | 2/2009 | Gorzen | 42/74 |
| 7,503,137 | B2 * | 3/2009 | Filicietti | 42/71.01 |
| 7,540,107 | B2 * | 6/2009 | Oum | 42/71.01 |
| 7,562,482 | B1 * | 7/2009 | Johnson | 42/90 |
| 7,637,049 | B1 * | 12/2009 | Samson et al. | 42/108 |
| 7,805,873 | B2 * | 10/2010 | Bentley | 42/74 |
| 7,937,873 | B2 * | 5/2011 | Keng | 42/71.01 |
| 2002/0083633 | A1 * | 7/2002 | Christiansen | 42/85 |
| 2004/0060220 | A1 * | 4/2004 | Peddie | 42/71.01 |
| 2006/0037227 | A1 * | 2/2006 | Bredeson | 42/90 |
| 2007/0101631 | A1 * | 5/2007 | Bentley | 42/74 |
| 2007/0261284 | A1 * | 11/2007 | Keng | 42/73 |
| 2008/0005951 | A1 * | 1/2008 | Gorzen | 42/14 |
| 2008/0190004 | A1 * | 8/2008 | Filicietti | 42/71.01 |
| 2010/0263255 | A1 * | 10/2010 | Harris | 42/90 |

* cited by examiner

SHELL STORAGE SYSTEM FOR GUNSTOCKS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to shell storage system used with gunstocks and particularly to shell storage systems removably attached to gunstocks.

2. Description of the Prior Art

Modern hunters and other gun users have always had a need to carry shells and ammunition with them in the field. Moreover, law enforcement and the military have long had a need for an easy way to carry shells and ammunition. Over the years many ammunition carriers have been designed to all people to carry extra shells and loads. Often these devices were kept apart from the gun. For example shells can be carried in belt pouches or in a vest. Some designs have been used to hold shotgun shells, for example, in sleeves that are slipped over the gunstock. This keeps the shells with the gun, but can interfere with the shooter as the shooter holds the gun.

BRIEF DESCRIPTION OF THE INVENTION

The instant invention overcomes these problems. It is an ammunition carrier that is attached to a gun in apposition that does not interfere with the operation of the gun. In this way, the user has ready access to ammunition with one of the problems of previous designs. The carrier is attached to the gun using a locking slider system. Once in place, it allows a shooter to carry up to 12 shells simply and easily. The carrier can be made in a straight-line design or a pistol grip type design.

The carrier has Velcro patches that allow the shell holders to be attached. The shell holders have elastic bands that hold the shells. One or two shell holders can be attached to the carrier as desired. Additionally, the user can keep several carriers available, each with a different type of shot or load so that the user simply has to select the desired ammunition for a particular purpose and attach it to the gun. Similarly, a user can keep several carriers ready if they are shooting a lot of shells, in a contest, for example. Once one carrier is exhausted, the user can simply slide it off and quickly replace it with a new set of shells.

DETAILED DESCRIPTION OF THE INVENTION

Figure 1:
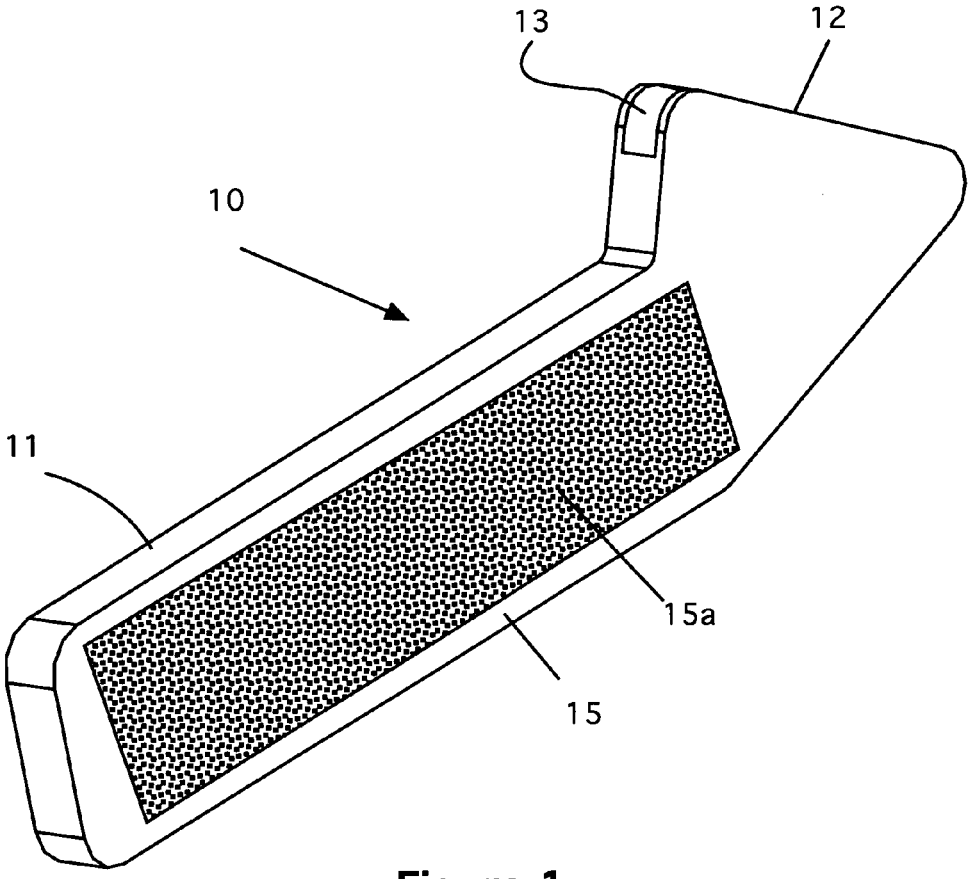
FIG. 1 is a perspective view of the first embodiment of the carrier body with no shell holders attached.

Referring now to FIG. 1, a perspective view of the first embodiment of the carrier body 10 with no shell holders attached. The carrier body 10 is made of a lightweight plastic. In this embodiment, the carrier 10 has an elongated front section 11 and a curved rear portion 12. A slot 13 is formed in the top of the rear portion as shown. The slot is used to slide the carrier onto the locking clip 14 (see FIG. 3) to secure the carrier to the gunstock. The carrier 10 has two flat sides 15 onto which one or two shell holders can be attached. Hook and loop type fasteners 15*a* are attached to the sides of the carrier to hold the shell holders when they are attached.

Figure 2:
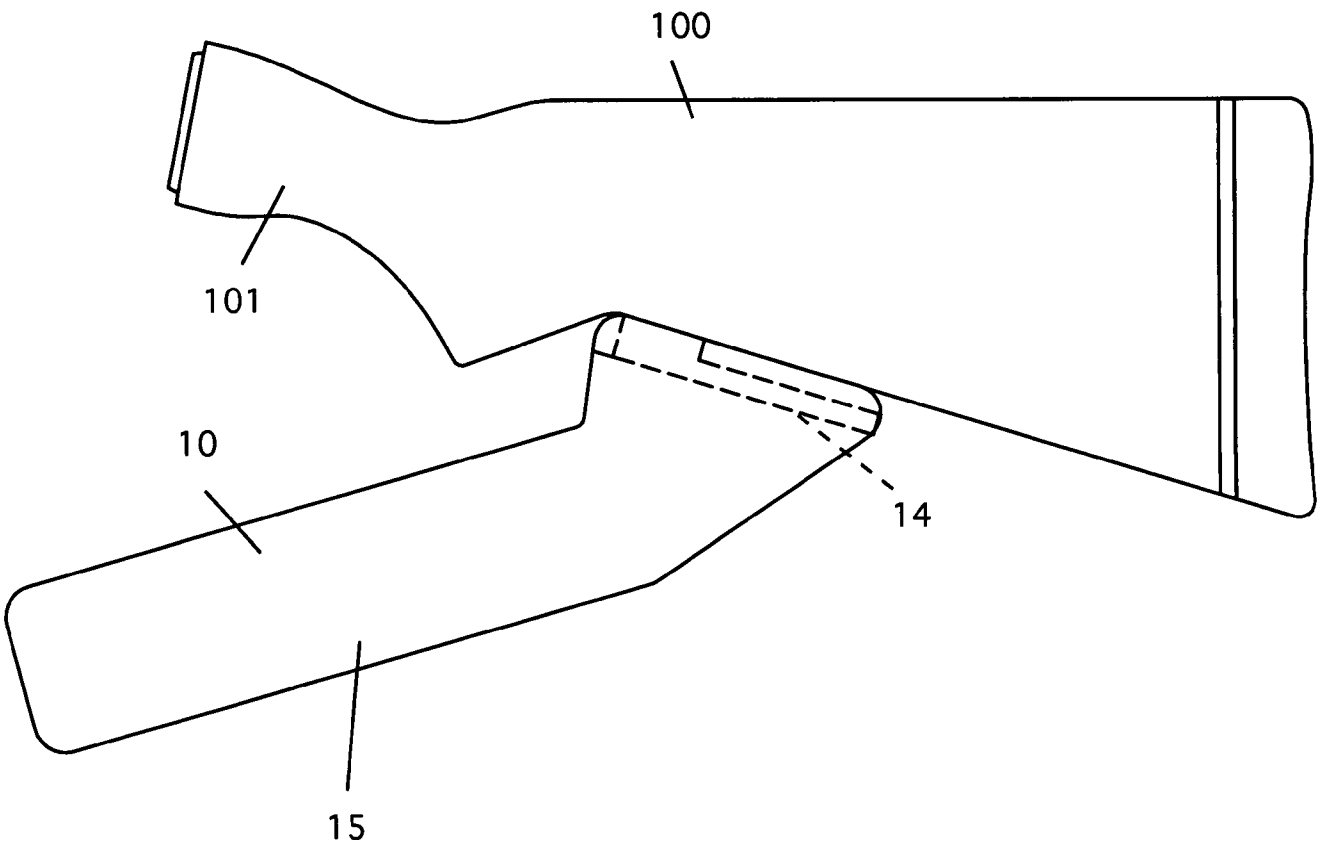
FIG. 2 is a side view of a gunstock showing the invention with no shell holders installed.

FIG. 2 is a side view of a gunstock 100 showing the invention 10 with no shell holders installed. As shown, the device is positioned below the gunstock behind the handgrip portion 101. The position of the carrier 10 on the gunstock does not interfere with normal operation of the gun and remains out of the way of the user. Note that the locking clip 14 is shown in dashed lines because it is installed in the slot 13.

Figure 3:
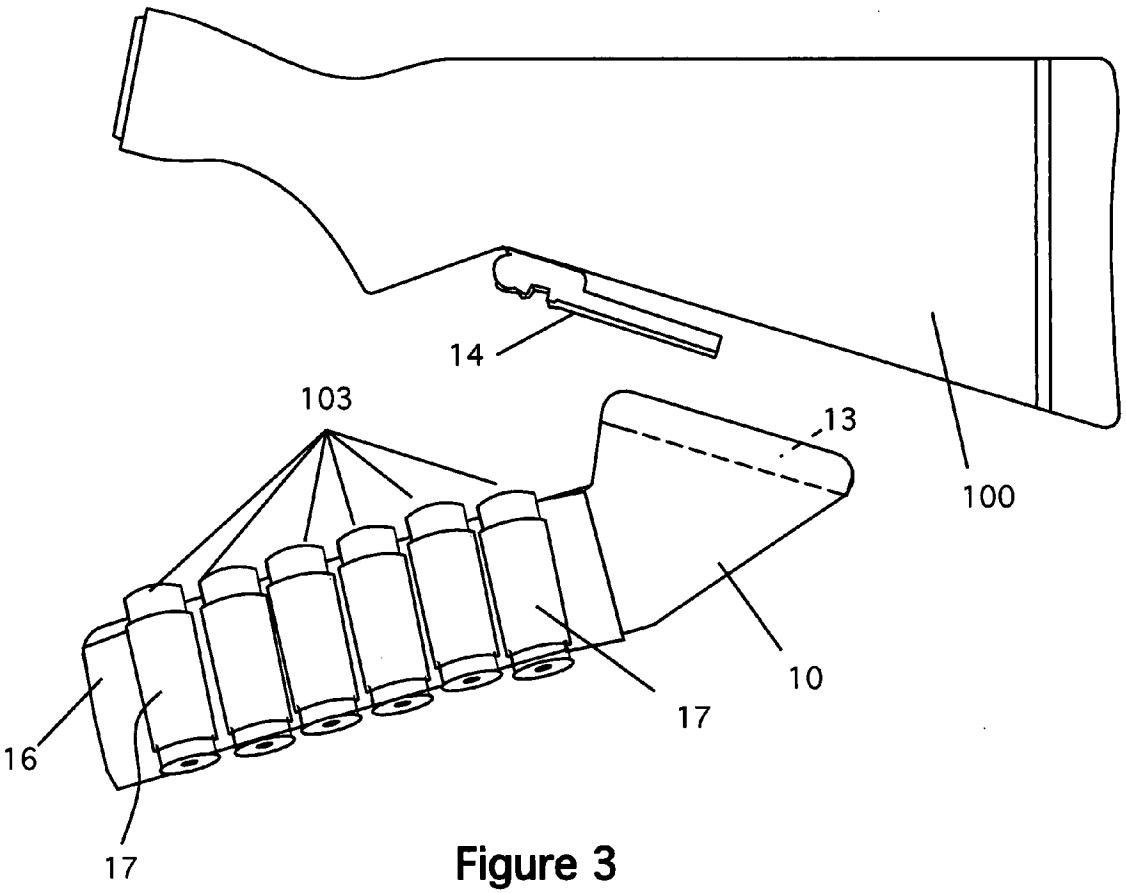
FIG. 3 is a side detail view of a gunstock with the carrier removed and a shell holder installed.

FIG. 3 is a side detail view of a gunstock with the carrier removed and a shell holder installed. Here, the locking clip 14 is shown positioned on the bottom of the gunstock 100. The carrier 10 is removed from the stock. The carrier is shown with a shell holder 16 loaded with shells 103. This shell holder 16 can hold 6 shells. Other sizes can be also made. The shells are held in loops 17 that accommodate the diameter of the shells. The loops can be made to hold a variety of sizes, or, loops sized for particular shells can be also made. This, a user can have a holder for 12 ga. shells and one for 20 ga. shells etc. Moreover, different sized shell holders can be placed on one carrier. Similarly, a user can have a carrier for 12 ga. shells, one for 20 ga. shells and so forth. This allows a shooter to keep an organized set of shells for every purpose that can be easily carried and used in the field.

Figure 4:
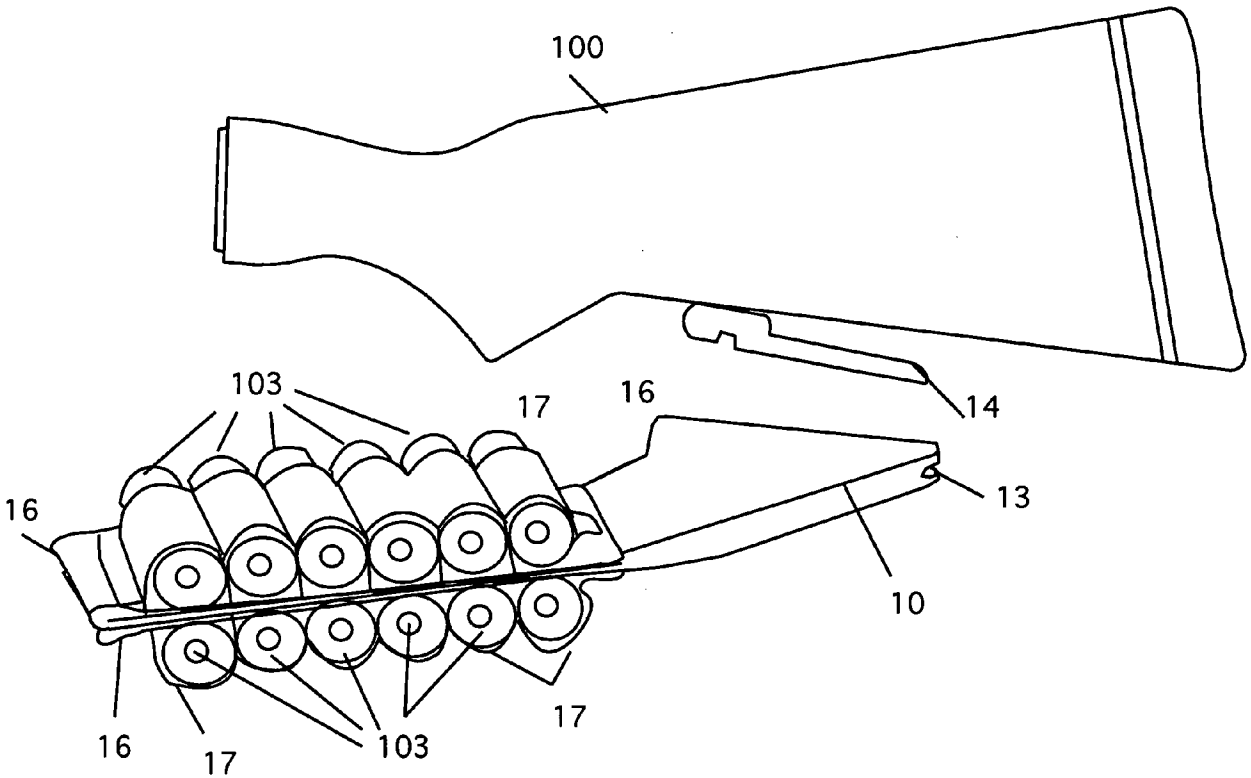
FIG. 4 is another side detail view of a gunstock with the carrier removed and a pair of shell holders installed.

FIG. 4 is another side detail view of a gunstock with the carrier removed and a pair of shell holders installed. In this view, both sides of the carrier 10 are shown. Here, both sides have shell holders attached and both are loaded with shells.

Figure 5:
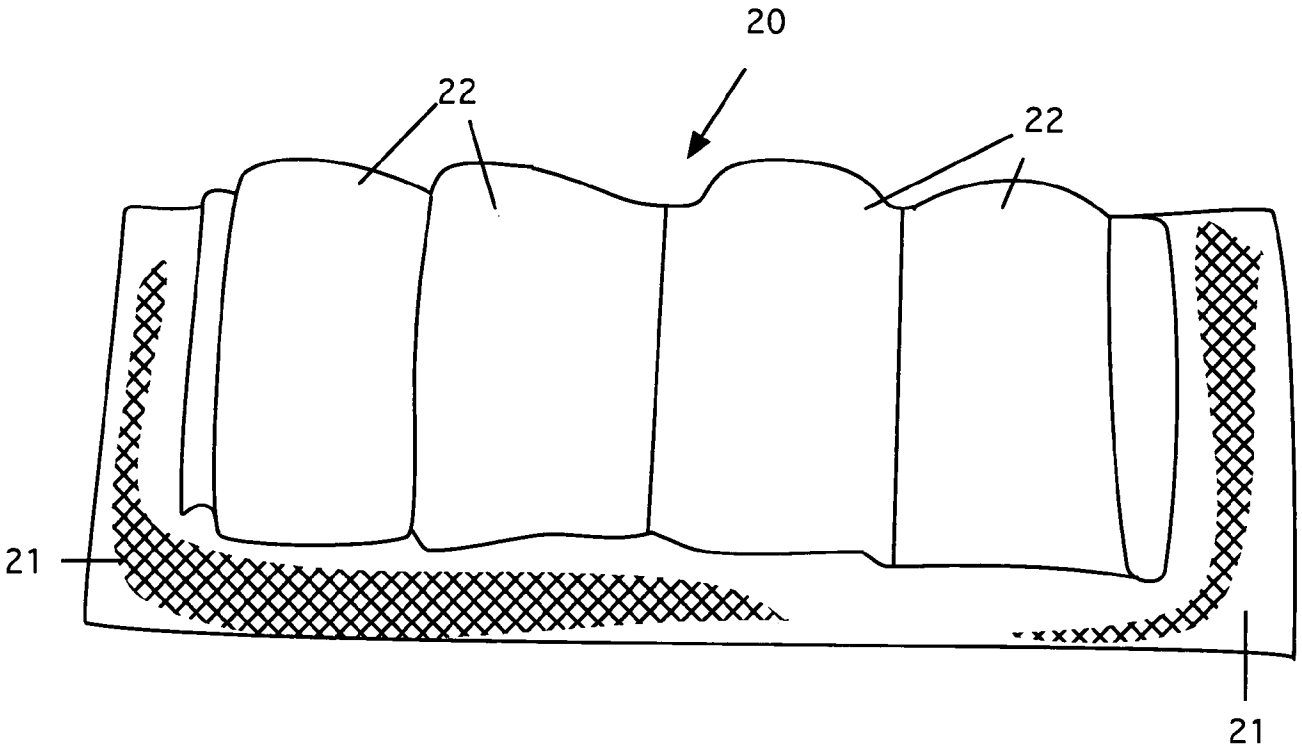
FIG. 5 is a top view of an empty 4-space shell holder.

FIG. 5 is a top view of an empty 4-space shell holder. This shell holder 20 can be used when not as many shells are needed, or for larger gauge shells. The shell holder has a base of webbing material 21 and the loops 22 that are sewn to the base. The back of the base is fitted with hook and loop type fastener 15*b* (see FIG. 8) that mates with the hook and loop fasteners attached to the carrier.

Figure 6:
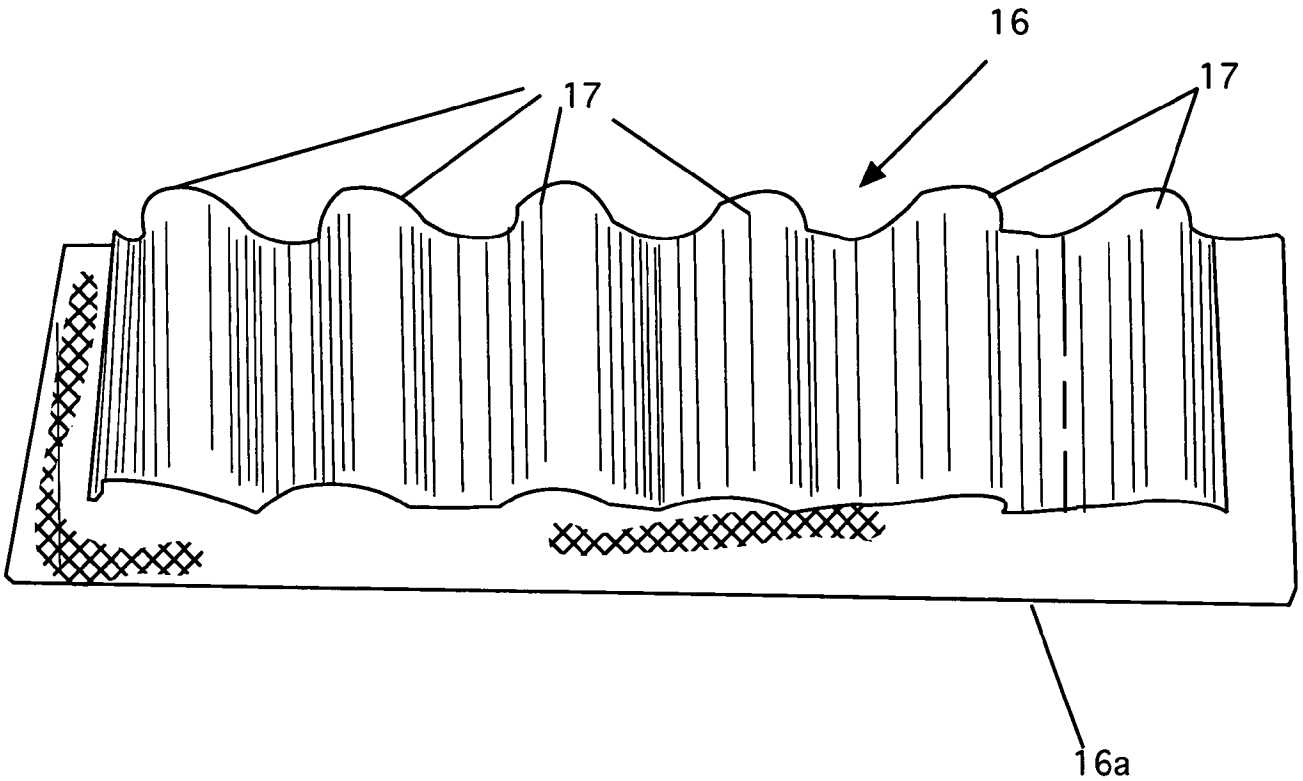
FIG. 6 is a top view of an empty 6-space shell holder.

FIG. 6 is a top view of an empty 6-space shell holder. As before, the shell holder 16 has a base of webbing material 16*a* and the loops 17 that are sewn to the base. The back of the base is fitted with hook and loop type fastener 15*b* (see FIG. 8) that mates with the hook and loop fasteners attached to the carrier.

Figure 7:
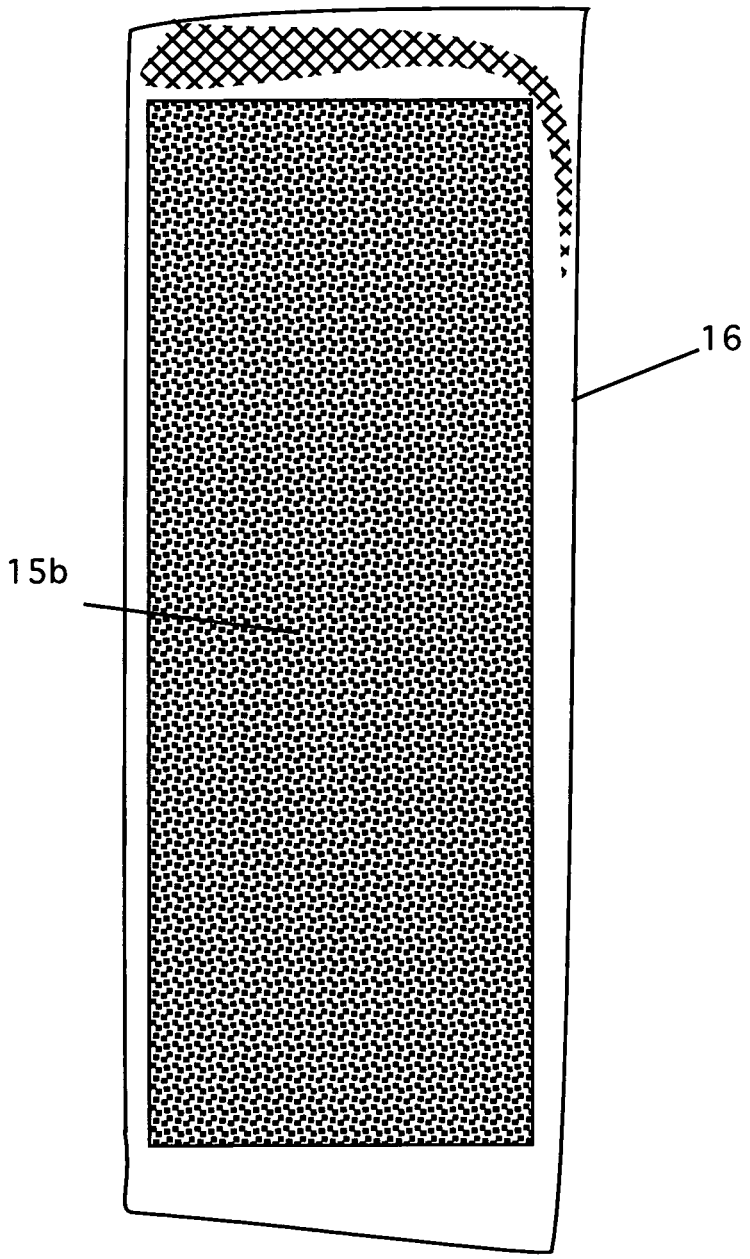
FIG. 7 is a rear view of a shell holder showing the hook and loop type fastener attached to it.

FIG. 7 is a rear view of a shell holder 16 showing the hook and loop type fastener 15*b* attached to it. This hook and loop fastener is attached to the hook and loop fastener on the carrier, as discussed above.

Figure 8:
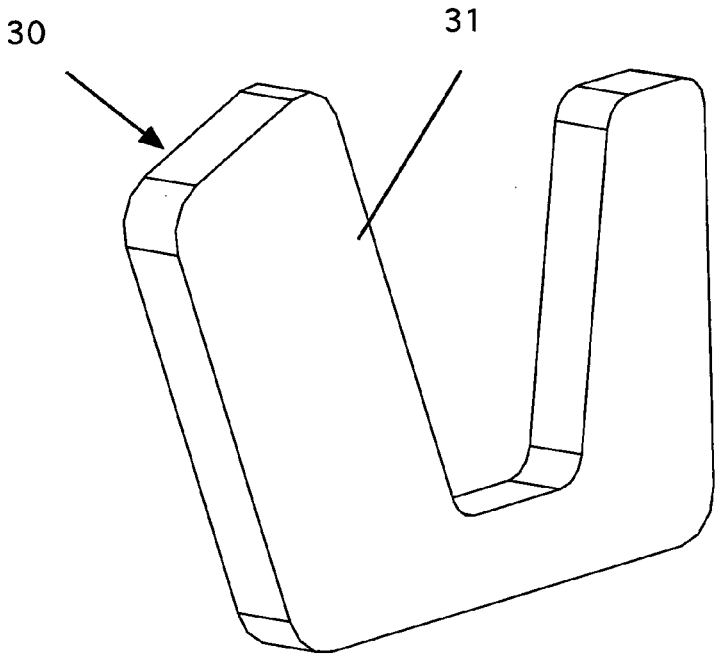
FIG. 8 is a detail view of second embodiment of a carrier.

The carrier can be made in a variety of shapes. However, the first embodiment is preferred. For those guns that have a pistol grip type stock, however, the carrier must be modified to accommodate that design. FIG. 8 is a detail view of second embodiment of a carrier. Here, the carrier 30 forms a "U" shape that conforms to the pistol grip gunstock. Shell holders are attached to the sides of the holder portion 31 in the same manner as the first embodiment. The second arm, or insertion arm, 32 is inserted into the pistol grip as discussed below. Note that this carrier can also carry ammo clips for rifles as well as shell holders.

Figure 9:
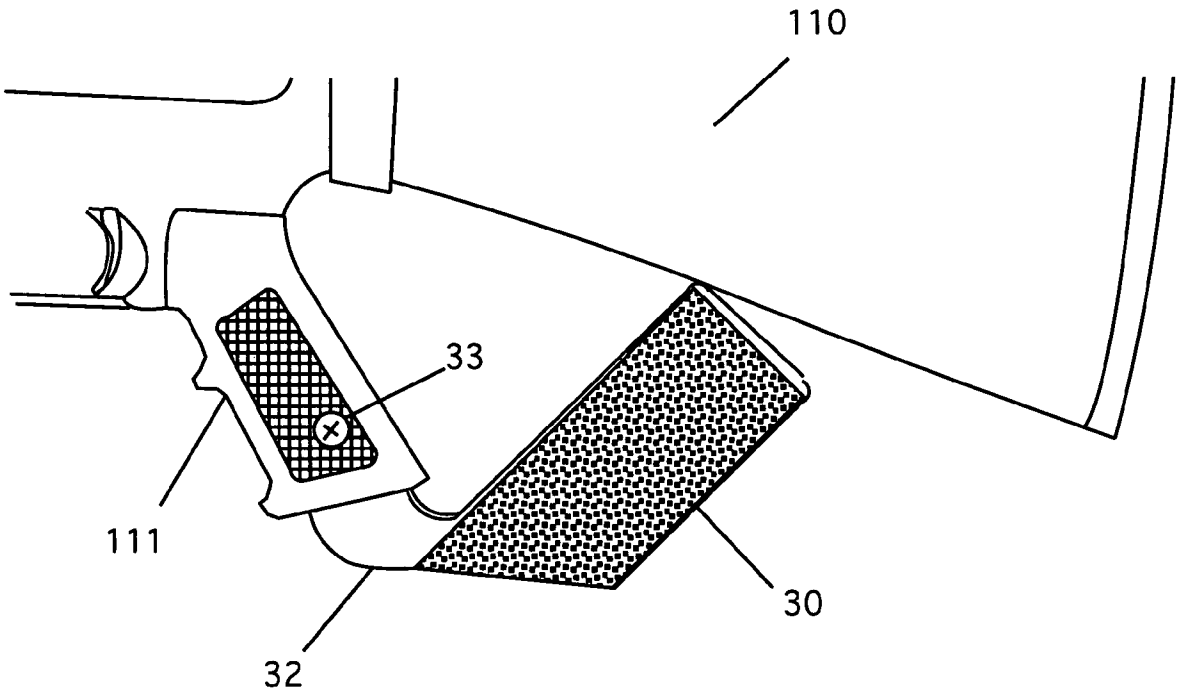
FIG. 9 is a detail view of the second embodiment installed in a pistol grip type rifle.

FIG. 9 is a detail view of the second embodiment 30 installed in a pistol grip type rifle 110. In this embodiment, the insertion arm 32 is inserted into the pistol grip 111 and is secured in place by a screw 33.

Figure 10:
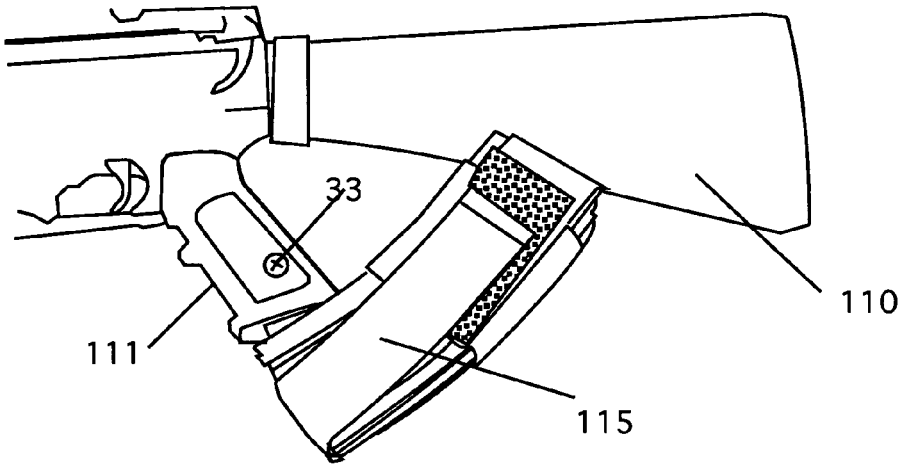
FIG. 10 is a detail view of the second embodiment installed in a pistol grip type rifle with an anno clip attached.
Figure 11:
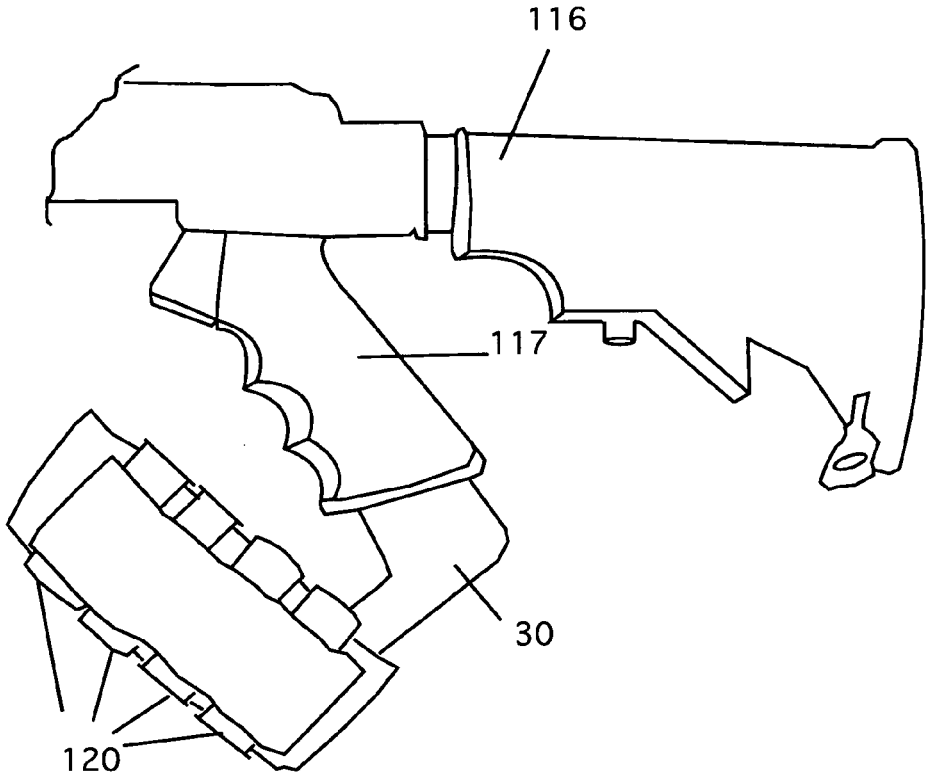
FIG. 11 is a detail view of the second embodiment installed in a pistol grip type shotgun with a load of shells attached.

FIG. 10 is a detail view of the second embodiment installed in a pistol grip type rifle with an anno clip attached. As discussed above, this device can be used with ammo clips. Here, an ammo clip 115 is shown attached to the carrier as shown. Note that when used with rifles, the carrier is positioned with the sides 31 extending backwards from the pistol grip. This is because the rifle magazine extends downward and the carrier interferes with the magazine FIG. 11 is a detail view of the second embodiment 30 installed in a pistol grip type shotgun 116 with a load of shells 120 attached. Here, the carrier is reversed with the carrying sides 31 extending forward of the pistol grip 117. As before the shell holders 20 are attached as before. A load of shells 120 can be carried on both sides of the carrier, as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A shell storage system for use with a gunstock having an underside and a pistol grip portion, comprising:

a) a carrier body having a "U" shaped body, said "U" shaped body having a holder portion having two generally flat parallel sides each having an exterior surface, and an insertion arm.

b) a means for securing said insertion arm into said pistol grip portion; and c) at least one shell holder, attached to said exterior surface of at least one of said two generally flat parallel sides of said holder portion of said carrier body.

2. The shell storage system of claim 1 wherein the carrier body further comprises: a pair of hook and loop type fasteners, one of said pair of hook and loop type fasteners being attached to an exterior surface on one of the two generally flat parallel sides of the holder portion of the carrier body.

3. The shell storage system of claim 1 wherein said means for securing said insertion arm into said pistol grip portion comprises a screw, installed in said carrier body and said pistol grip portion.

4. The shell storage system of claim 1 wherein the at least one shell holder holds four shells.

5. The shell storage system of claim 1 wherein the at least one shell holder holds six shells.

6. The shell storage system of claim 1 wherein the holder portion holds at least one ammo clip for a rifle secured to the exterior surface of said holder portion.

7. The shell storage system of claim 1 wherein the gunstock is a gunstock for a rifle.

8. The shell storage system of claim 7 wherein the carrier is position such that the holder portion extends rearward from said pistol grip portion.

9. The shell storage system of claim 1 wherein the gunstock is a gunstock for a shotgun.

10. The shell storage system of claim 9 wherein the carrier is positioned such that the holder portion extends forward from said pistol grip portion.

* * * * *